US011069990B2

(12) United States Patent
Collins

(10) Patent No.: US 11,069,990 B2
(45) Date of Patent: Jul. 20, 2021

(54) PIN ADAPTER TYPE CABLE CONNECTORS

(71) Applicant: Hubbell Incorporated, Shelton, CT (US)

(72) Inventor: Gregory Scott Collins, Franklin, TN (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/812,118

(22) Filed: Mar. 6, 2020

(65) Prior Publication Data

US 2020/0295473 A1 Sep. 17, 2020

Related U.S. Application Data

(60) Provisional application No. 62/819,298, filed on Mar. 15, 2019.

(51) Int. Cl.

| | |
|---|---|
| ***H01R 4/36*** | (2006.01) |
| ***H01R 13/04*** | (2006.01) |
| ***H01R 11/11*** | (2006.01) |
| ***H01R 4/30*** | (2006.01) |
| ***H01R 4/62*** | (2006.01) |
| ***H01R 13/621*** | (2006.01) |

(52) U.S. Cl.

CPC ..... *H01R 4/36* (2013.01); *H01R 4/307* (2013.01); *H01R 4/62* (2013.01); *H01R 11/11* (2013.01); *H01R 13/04* (2013.01); *H01R 13/621* (2013.01)

(58) Field of Classification Search

CPC ..... H01R 4/36; H01R 4/302; H01R 4/307; H01R 4/62; H01R 11/11; H01R 13/04; H01R 13/621

USPC ..... 439/797

See application file for complete search history.

(56) References Cited

U.S. PATENT DOCUMENTS

| | | | | |
|---|---|---|---|---|
| 3,125,397 A * | 3/1964 | McGrath | H01R 4/363 | 439/811 |
| 3,622,946 A | 11/1971 | Rogers | | |
| 4,659,267 A * | 4/1987 | Uno | F16B 31/021 | 411/410 |
| 5,201,678 A * | 4/1993 | Venezia | H01R 4/36 | 439/723 |
| 6,329,592 B1 * | 12/2001 | Auclair | H01R 4/32 | 174/135 |

(Continued)

OTHER PUBLICATIONS

International Search Report and Written Opinion mailed in corresponding International Application PCT/US20/21575 dated Mar. 15, 2019 (8 pages).

(Continued)

*Primary Examiner* — Peter G Leigh

(74) *Attorney, Agent, or Firm* — Wissing Miller LLP

(57) ABSTRACT

The present disclosure provides pin adapter type cable connectors used to terminate electrical conductors into mechanical connectors or other terminations typically found in electrical equipment. The connectors include a connector body having a conductor bore to receive a bare portion of an electrical conductor, a fastener that is coupled to the connector body and used to secure the bare portion of an electrical conductor to the connector body, and a pin adapter having an adapter body that can be removably connected to the connector body and a pin extending from the adapter body.

23 Claims, 15 Drawing Sheets

(56) References Cited

U.S. PATENT DOCUMENTS

| | | | | |
|---|---|---|---|---|
| 7,717,658 | B2 * | 5/2010 | Peltier | F16B 31/021 411/411 |
| 7,976,352 | B2 * | 7/2011 | Nishimura | H01R 4/36 439/814 |
| 8,030,570 | B2 * | 10/2011 | Seraj | H02G 15/1833 174/88 C |
| 8,747,170 | B2 * | 6/2014 | Cornelius | H01R 11/11 439/798 |
| 9,472,865 | B2 * | 10/2016 | Frank | F16B 31/021 |
| 9,553,374 | B1 * | 1/2017 | Murugiah | H01R 4/36 |
| 9,929,477 | B2 * | 3/2018 | Beiler | F16B 35/042 |
| 10,135,158 | B2 * | 11/2018 | Peltier | H01R 4/36 |
| 2004/0067697 | A1 * | 4/2004 | Zahnen | H01R 11/05 439/798 |
| 2005/0202732 | A1 * | 9/2005 | Rizzo | H01R 11/09 439/810 |
| 2008/0268721 | A1 * | 10/2008 | Waltz | H01R 13/523 439/793 |
| 2010/0248542 | A1 * | 9/2010 | Nishimura | H01R 4/36 439/607.01 |
| 2016/0240941 | A1 | 8/2016 | Stavrianoudakis et al. | |

OTHER PUBLICATIONS

Mechanical Pin Adaptor Sneak Preview Catalog, Dec. 21, 2017, pp. 1-2, Burndy LLC, www.burndy.com.

Mechanical Pin Adaptor, Mar. 2, 2018, Bumdy LLC, www.burndy.com.

Mechanical Pin Adaptor Sheet, Mar. 2, 2018, Burndy LLC, www.burndy.com.

Mechanical Pin Adaptor Introduction Sheet,Mar. 2, 2018, Burndy LLC, www.burndy.com.

ReduceR Cable Reducing Adapters, Rev Jan. 2014, pp. 1-2, Greaves Corporation, www.greaves-usa.com.

Shoo-pin Flex-Cable Adapters, Rev Jan. 2014, pp. 1-2, Greaves Corporation, www.greaves-usa.com.

* cited by examiner

Fig. 4
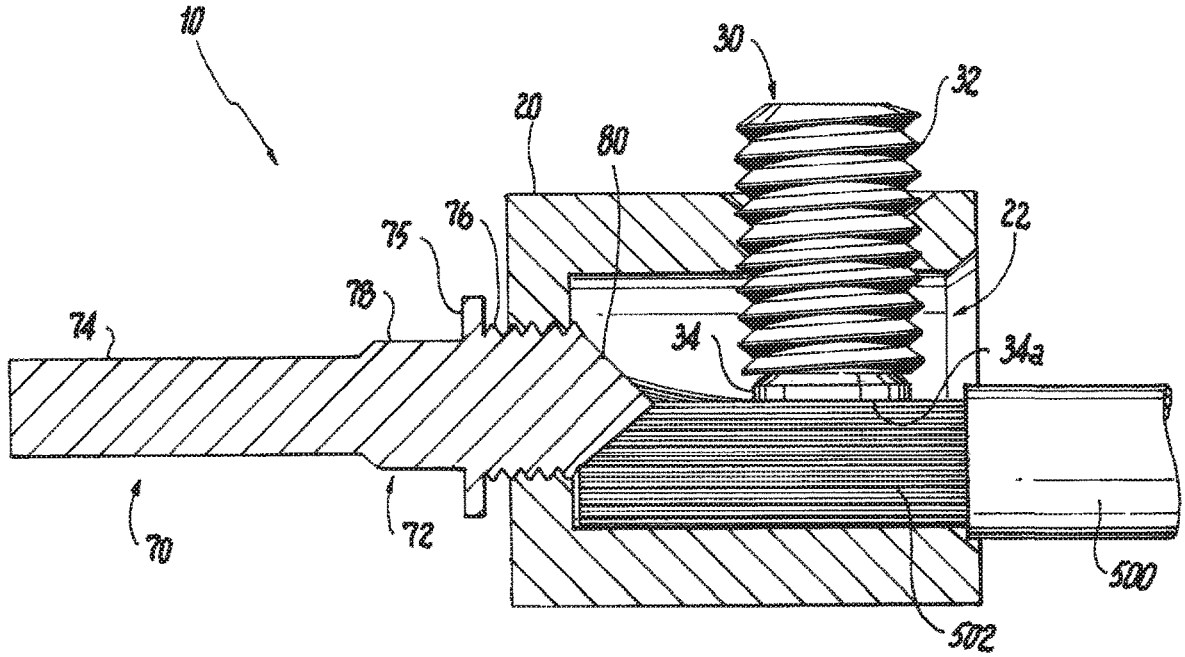
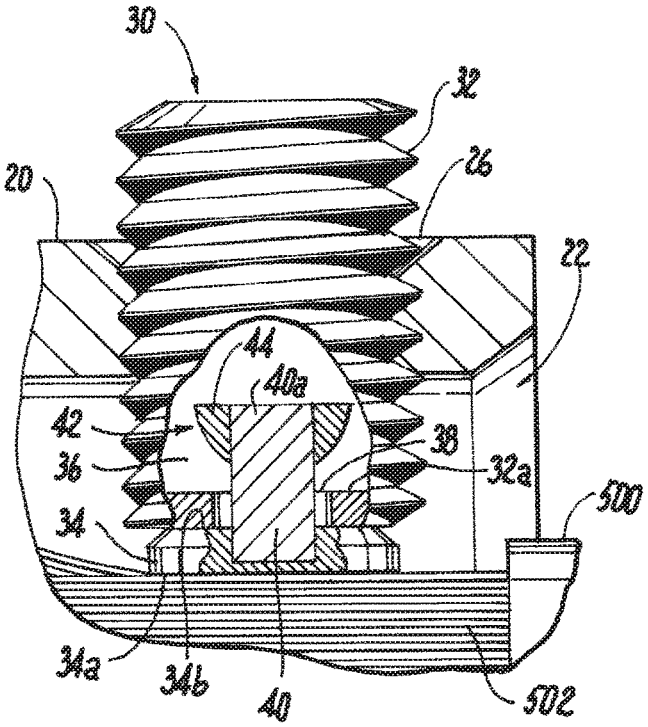
Fig. 4a

PIN ADAPTER TYPE CABLE CONNECTORS

CROSS-REFERENCE TO RELATED APPLICATIONS

The present disclosure is based on and claims benefit from U.S. Provisional Patent Application Ser. No. 62/819,298 filed on Mar. 15, 2019 entitled "Pin Adapter Type Cable Connectors" the contents of which are incorporated herein in their entirety by reference.

BACKGROUND

Field

The present disclosure relates to pin adapter type cable connectors used to terminate stranded electrical conductors into mechanical connectors or terminations typically found in electrical equipment.

Description of the Related Art

Electrical connections between large size electrical conductors and electrical equipment are typically made using mechanical connectors or terminations. For stranded electrical conductors with more fine strands, it is not desirable to secure the stranded conductors directly into the mechanical connectors or terminations of electrical equipment, such as electrical panels, electrical switch gear power feed or disconnect equipment, circuit breakers, and other electrical equipment. Therefore, a need exists for an adapter that can be used to ensure a more robust electrical connection between the stranded conductors and the mechanical connectors or terminations of electrical equipment.

SUMMARY

The present disclosure relates to pin adapter type cable connectors used to terminate electrical conductors into mechanical connectors or other terminations typically found in electrical equipment, including electrical panels, switch gear boxes, circuit breakers, and other electrical equipment. The connectors include a connector body having a conductor bore to receive a bare portion of an electrical conductor, a fastener that is coupled to the connector body and used to secure the bare portion of an electrical conductor to the connector body, and a pin adapter or pin extending from the connector body.

In one exemplary embodiment, the cable connector includes a connector body, at least one fastener and a pin adapter. The connector body has a conductor bore, a pin adapter bore, and at least one fastener bore in communication with the conductor bore. The at least one fastener is movably received within the at least one fastener bore so that the at least one fastener can enter the conductor bore. The pin adapter is removably secured within the pin adapter bore. The pin adapter includes an adapter body adapted to be received within the pin adapter bore and a pin extending from the adapter body. The cable connector may also include an insulating cover that fits at least around the connector body and/or at least a portion of the pin adapter. The fastener includes a fastener body and a fastener plate operatively coupled to the fastener body so that the fastener plate is independently movable relative to the fastener body. The adapter body includes a mounting portion, e.g., threads, a tightening portion extending from a first end of the mounting portion and a tip portion extending from a second end of the mounting portion. The tip portion may include a pointed tip or a blunt tip. The pin of the pin adapter may be a straight pin or the pin may have one or more bends. Example of bends the pin may have include 22-degree bends, 45-degree bends, a 90-degree bends and asymmetric type bends such as S-shaped type bends.

In another exemplary embodiment, the cable connector includes a connector body, at least one fastener and a pin extending from the connector body. The connector body has a conductor bore and at least one fastener bore in communication with the conductor bore. The at least one fastener is movably received within the at least one fastener bore so that the at least one fastener can enter the conductor bore. The pin has one end permanently secured to the connector body and a free end. The cable connector may also include an insulating cover that fits at least around the connector body and/or at least a portion of the pin. The at least one fastener includes a fastener body and a fastener plate operatively coupled to the fastener body so that the fastener plate is independently movable relative to the fastener body. The pin may be a straight pin or the pin may have one or more bends. Example of bends the pin may have include 22-degree bends, 45-degree bends, a 90-degree bends and asymmetric type bends such as S-shaped type bends.

In another exemplary embodiment, the cable connector includes a connector body, at least one fastener, a pin adapter extending from the connector body, and an insulating cover. The connector body has a conductor bore, a pin adapter bore, and at least one fastener bore in communication with the conductor bore. The at least one fastener is movably received within the at least one fastener bore such that the at least one fastener can enter the conductor bore. The pin adapter is removably secured within the pin adapter bore, and includes an adapter body adapted to be received within the pin adapter bore and a pin extending from the adapter body. The insulating cover fits at least around the connector body. In another embodiment the cover fits around the connector body and at least a portion of the pin adapter.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 4 is a cross-sectional view of the mechanical type cable connector of FIG. 1 taken along line 4-4, illustrating a bare portion of a conductor secured within the connector body using the mechanical fastener, and the pin adapter secured to the connector body and contacting the bare portion of the conductor;

FIG. 4A is an enlarged detailed view of a portion of the mechanical type cable connector of FIG. 4 in partial cut away, illustrating the fastener securing the bare portion of the conductor to the connector body, where the fastener includes a fastener body and a floating fastener plate coupled to the fastener body so that the fastener plate can move independently of the main body and can contact the bare conductor portion when securing the bare conductor portion of the conductor to the connector body;

DETAILED DESCRIPTION

The present disclosure relates to pin adapter type cable connectors used to terminate electrical conductors to mechanical connectors or other terminations typically found in electrical equipment, including electrical panels, electrical switch gear power or disconnect equipment, circuit breakers, and other electrical equipment. The electrical conductors contemplated by the present disclosure include stranded electrical conductors that include an insulating jacket covering bare strands of wire and are generally referred to as the "conductors" in the plural and the "conductor" in the singular. The strands of wire may be fine strands of wire typically found in DLO type wire or the strands may be less fine as in typical stranded electrical wire. The conductors can range in size from about #6 AWG to about 1111 kcmil. For ease of description, the pin adapter type cable connectors may also be referred to herein as the "connectors" in the plural and the "connector" in the singular. The connectors may be mechanical type connectors where one or more mechanical fasteners are used to releasably secure conductors to the connectors. The connectors may be compression type connectors where the part of the connector holding the bare wire of the conductors is compressed to permanently secure conductors to the connectors.

Figure 1:
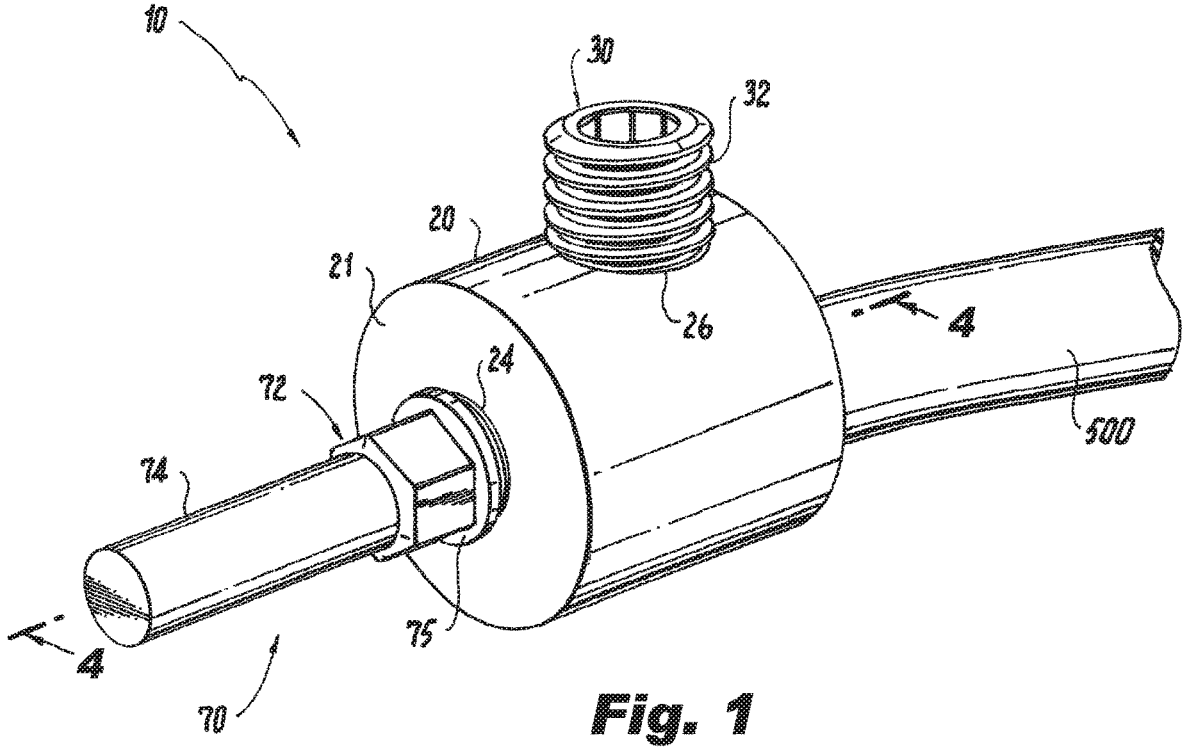
FIG. 1 is a perspective view of an exemplary embodiment of a mechanical type cable connector according to the present disclosure, illustrating a connector body having an adapter body bore, and a pin adapter having an adapter body installed in the adapter body bore and a straight pin extending from the adapter body, and illustrating a single mechanical fastener used to secure a conductor to the connector body.
Figure 2:
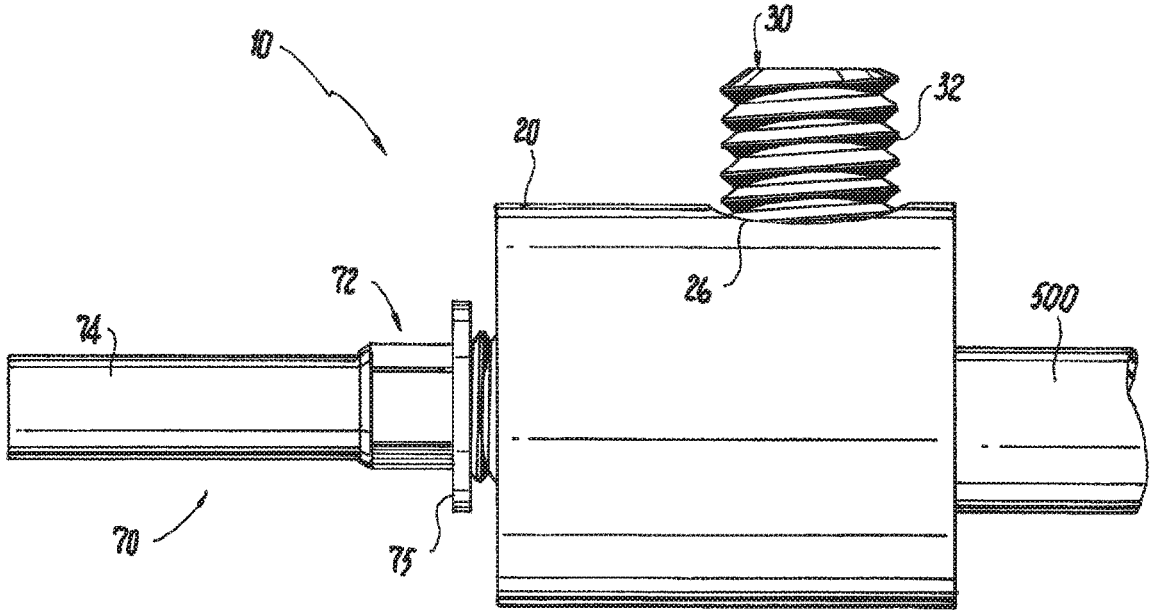
FIG. 2 is a side elevation view of the mechanical type cable connector of FIG. 1.
Figure 3:
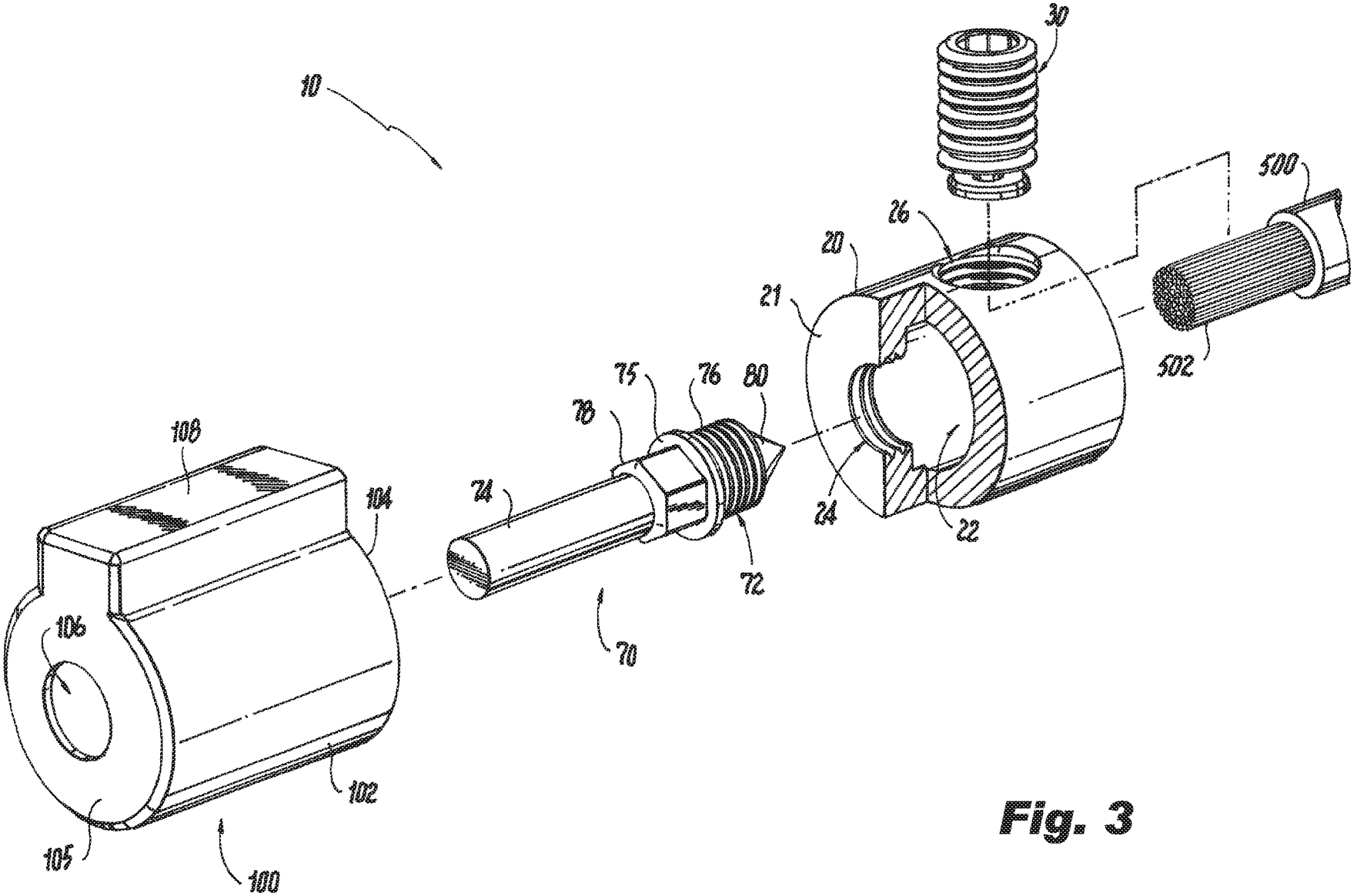
FIG. 3 is an exploded perspective view of the mechanical type cable connector of FIG. 1, illustrating the connector body, the pin adapter and an insulating cover that can be positioned over the connector body and the pin adapter.

Referring to the FIG. 1-3, an exemplary embodiment of a connector according to the present disclosure is shown. In this exemplary embodiment, the connector 10 includes a connector body 20 and a pin adapter 70. The connector body 20 is preferably a circular or cylindrical body that is made of an electrically conductive material, such as aluminum, copper or brass. The conductor body 20 includes a conductor bore 22, a pin adapter bore 24 and a fastener bore 26. The conductor bore 22 is configured to receive a bare portion 502 of an electrical conductor 500, as shown in FIG. 3. Preferably, the wall of the conductor bore 22 is a smooth wall. The pin adapter bore 24 is configured to receive an adapter body 72 of the pin adapter 70, which is described in more detail below. The fastener bore 26 is in this exemplary embodiment a threaded bore that receives a threaded fastener 30 used to secure the bare portion 502 of the conductor 500 within the conductor bore 22 to the connector body 20.

Referring to FIGS. 3, 4 and 4A, the fastener 30 in this exemplary embodiment is a set screw having a threaded fastener body 32 and a floating fastener plate 34. The fastener body 32 has a hollow center portion 36 and a bore 38 through a bottom wall 32*a* of the fastener body 32 as seen in FIG. 4A. The threaded portion of the fastener body 32 is configured to fit within the fastener bore 26 of the connector body 20. The fastener plate 34 has a conductor engaging surface 34*a* and a body engaging surface 34*b* which is opposite the conductor engaging surface 34*a*. The fastener plate 34 includes a coupling pin 40 extending from the body engaging surface 34*b* that is used to couple the fastener plate 34 to the fastener body 32 so that the fastener plate 34 can float or move independently of the fastener body. More specifically, the coupling pin 40 is integrally or monolithically formed into the fastening plate 34 and preferably extends perpendicular to the body engaging surface 34*b*. A distal end 40*a* of the coupling pin 40 includes a coupling joint 42 that couples the fastener plate 34 to the fastener body 32 while permitting the fastener plate 34 to float or move independent of the fastener body 32. In the exemplary embodiment shown in FIGS. 4 and 4A, the coupling joint 42 includes a ball structure or a half-ball structure 44 secured to the distal end 40*a* of the coupling pin 40. The ball structure 44 combined with the bore 38 through the bottom wall 32*a* of the fastener body 32 form a ball and socket type joint, where the fastener plate 34 is independently movable relative to the fastener body 32 while still being coupled to the fastener body. Having the fastener plate 34 independently movable relative to the fastener body 32 permits the fastener plate 34 to engage a bare portion 502 of a conductor 500 within the conductor bore 22 and remain in a fixed position on the bare portion 502 of the conductor. As a result, as the fastener body 32 is threaded into the fastener bore 26 a compression force is applied by the fastener body 32 and fastener plate 34 to the bare portion 502 of the conductor 500 without or with limited movement, e.g., rotation, of the fastener plate 34. Minimizing movement of the fastener plate 34 relative to the bare portion of the conductor 500 minimizes or possibly prevents damage to the bare portion 502 of the conductor.

Figure 16:
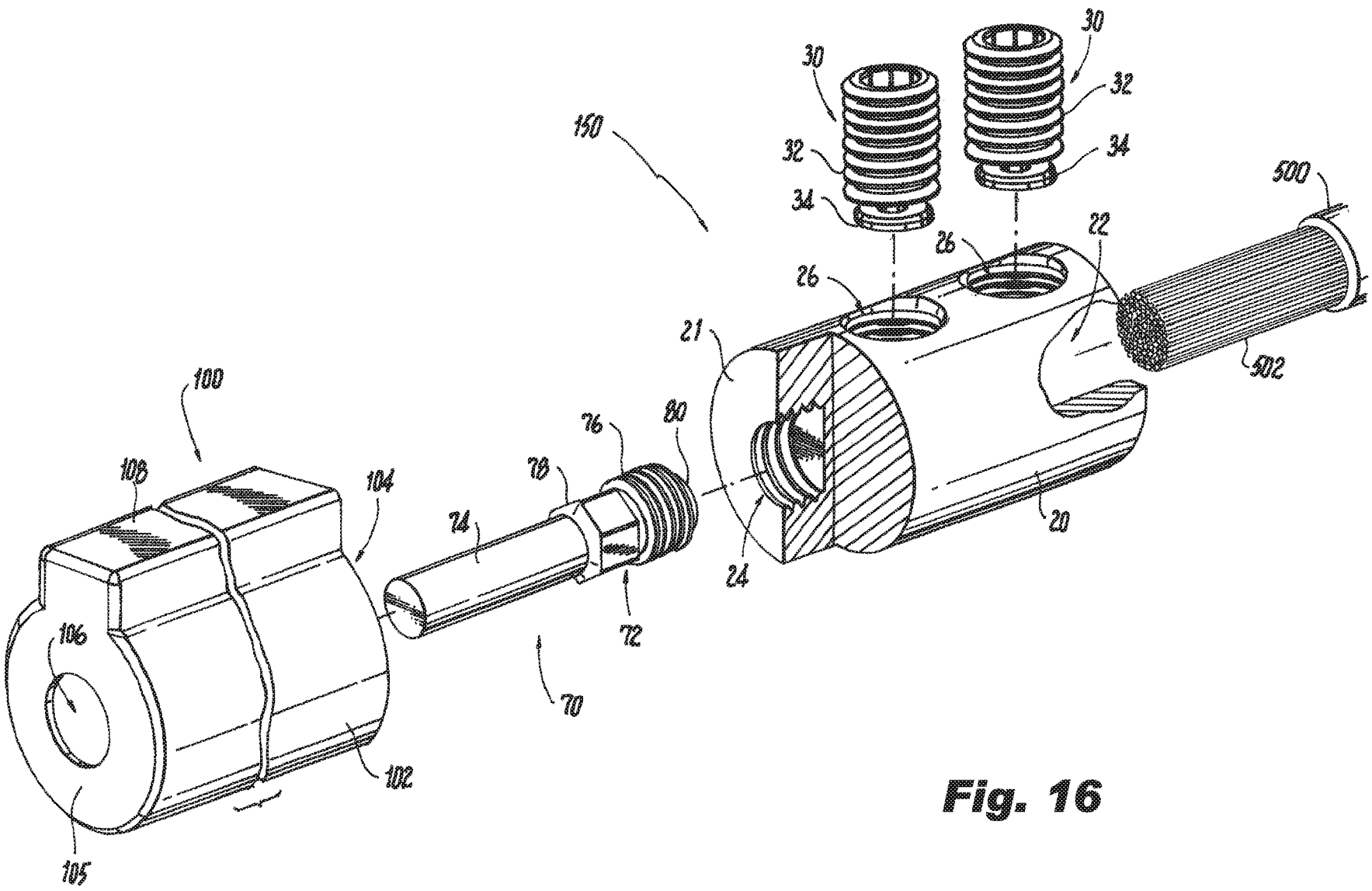
FIG. 16 is an exploded perspective view of another exemplary embodiment of a mechanical type cable connector according to the present disclosure, illustrating a connector body having an adapter body bore, a pin adapter having an adapter body installed in the adapter body bore and a straight pin extending from the adapter body, an insulating cover, and multiple fasteners used to secure a conductor to the connector body.
Figure 17:
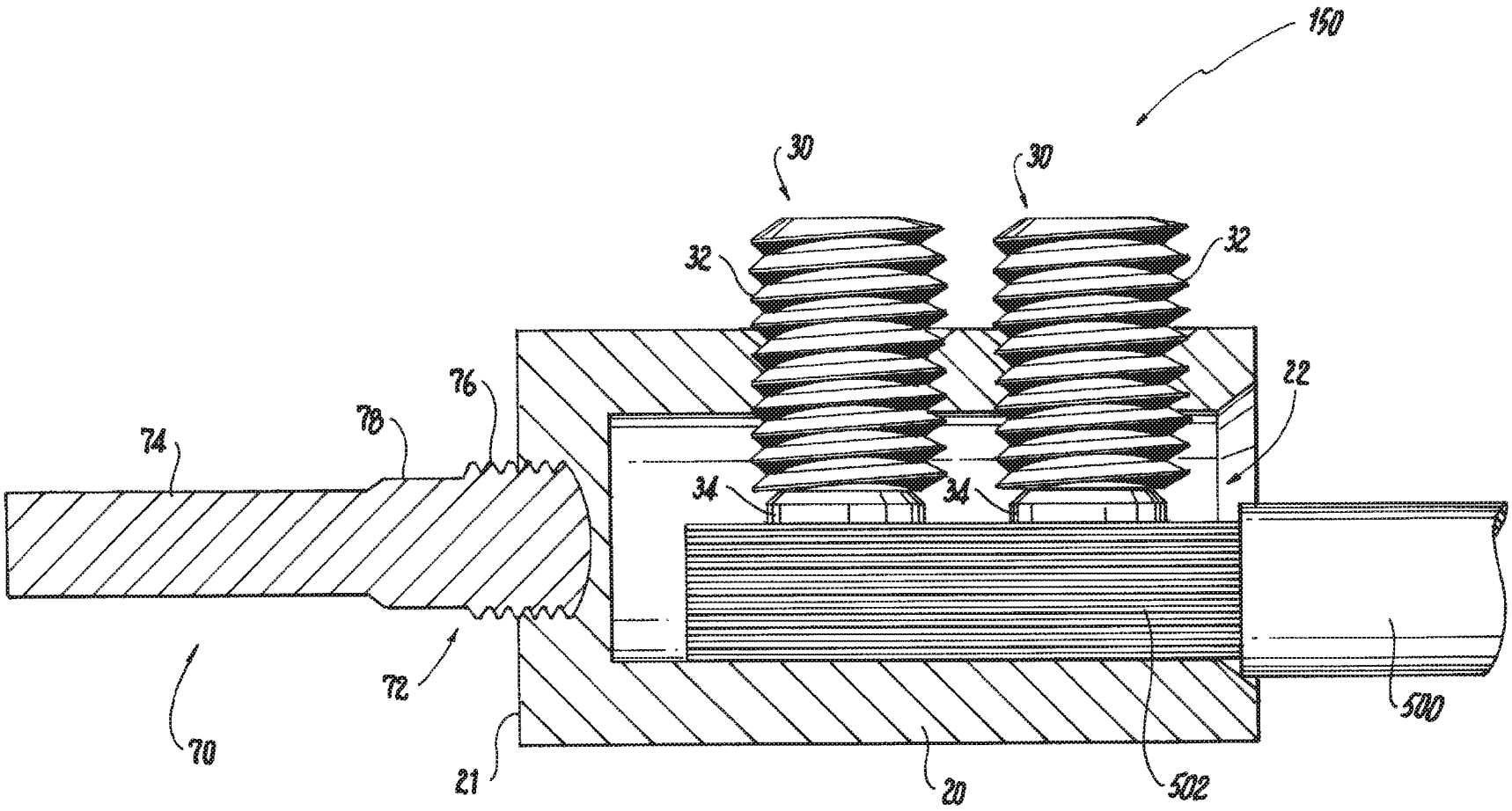
FIG. 17 is a cross-sectional view of the mechanical type cable connector of FIG. 16, illustrating a bare portion of a conductor secured within the connector body with the multiple fasteners and the pin adapter secured to the connector body.

Referring now to FIGS. 3, 16 and 17, exemplary embodiments of the pin adapter 70 according to the present disclosure will be described. In the exemplary embodiment of FIG. 3, the pin adapter 70 includes an adapter body 72 and a pin 74 extending from the adapter body. The adapter body 72 is made of an electrically conductive material, such as aluminum, copper or brass. The adapter body 72 is configured to removably secure the pin 74 to the conductor body 20 via the adapter bore 24. In the exemplary embodiment shown, the adapter body 72 includes a mounting portion 76, an optional stop portion 75, a tightening portion 78 and a tip portion 80. The mounting portion 76 may be a threaded portion that is configured to be threaded into the threaded pin adapter bore 24 in the conductor body 20. The optional stop portion 75 limits the depth the mounting portion 76 extends into the pin adapter bore 24 and possibly the depth the tip portion 80 extends into the conductor bore 22. The tightening portion 78 may be a hexagon shaped member, like a nut, that can be used to tighten the adapter body 72 within the pin adapter bore 24 using, for example, a wrench. The tip portion 80 may have different shapes. The tip portion 80 may be a pointed tip, seen in FIG. 3, or a blunt tip, seen in FIG. 16, that may extend into the conductor bore 22 so that the tip portion 80 is capable of contacting the bare portion 502 of the conductor 500. By contacting the bare portion 502 of the conductor 500, an electrical connection between the pin adapter 70, the connector body 20 and the conductor 500 may be improved. In another exemplary embodiment, the tip portion 80 of the adapter body 72 may not extend into the conductor bore 22, as seen in FIG. 17.

Figure 5:
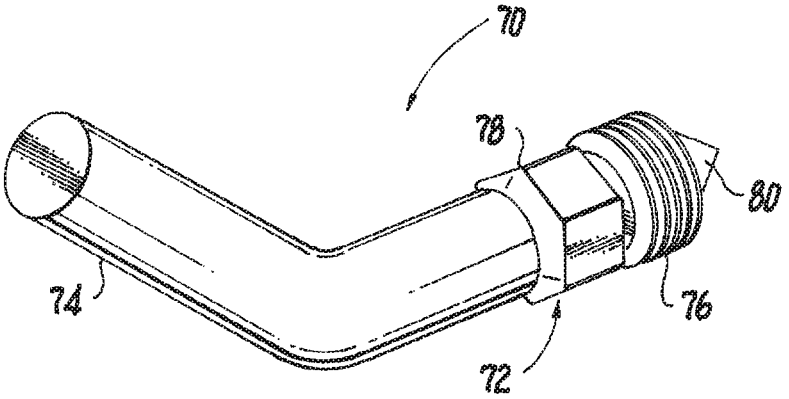
FIG. 5 is a perspective view of another exemplary embodiment of a pin adapter according to the present disclosure, illustrating an adapter body with a pointed tip and a pin extending from the adapter body having a 45-degree bend.
Figure 6:
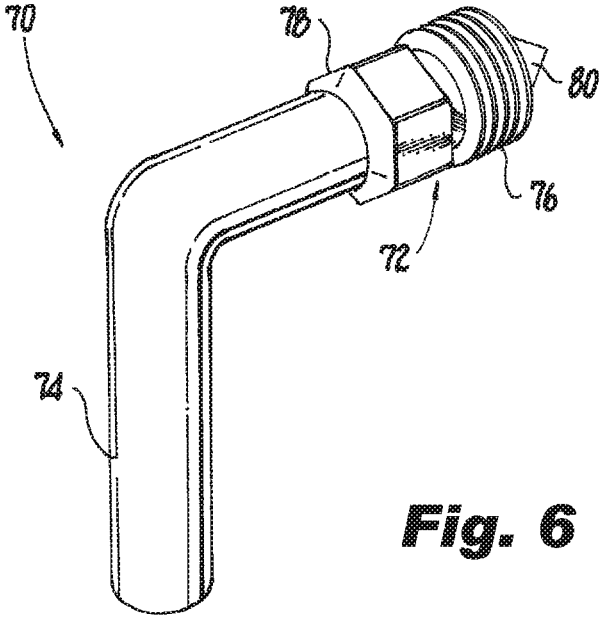
FIG. 6 is a perspective view of another exemplary embodiment of a pin adapter according to the present disclosure, illustrating an adapter body with a pointed tip and a pin extending from the adapter body having a 90-degree bend.
Figure 7:
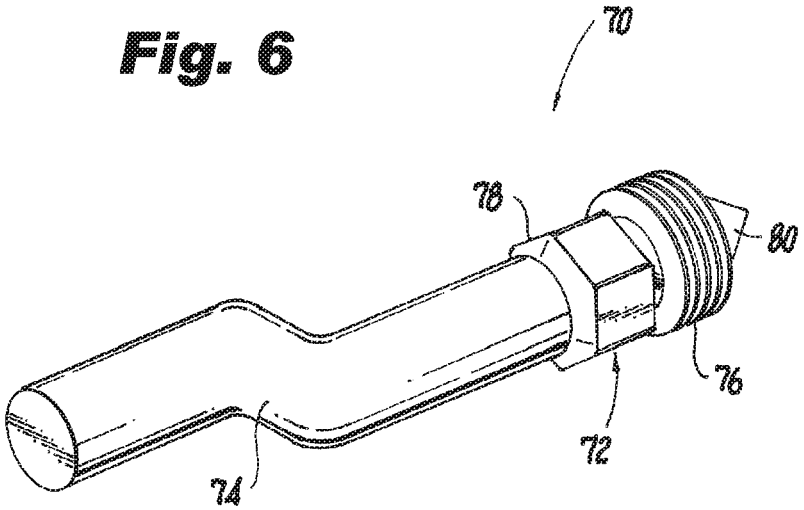
FIG. 7 is a perspective view of another exemplary embodiment of a pin adapter according to the present disclosure, illustrating an adapter body with a pointed tip and a pin extending from the adapter body having an S-shaped bend.
Figure 19:
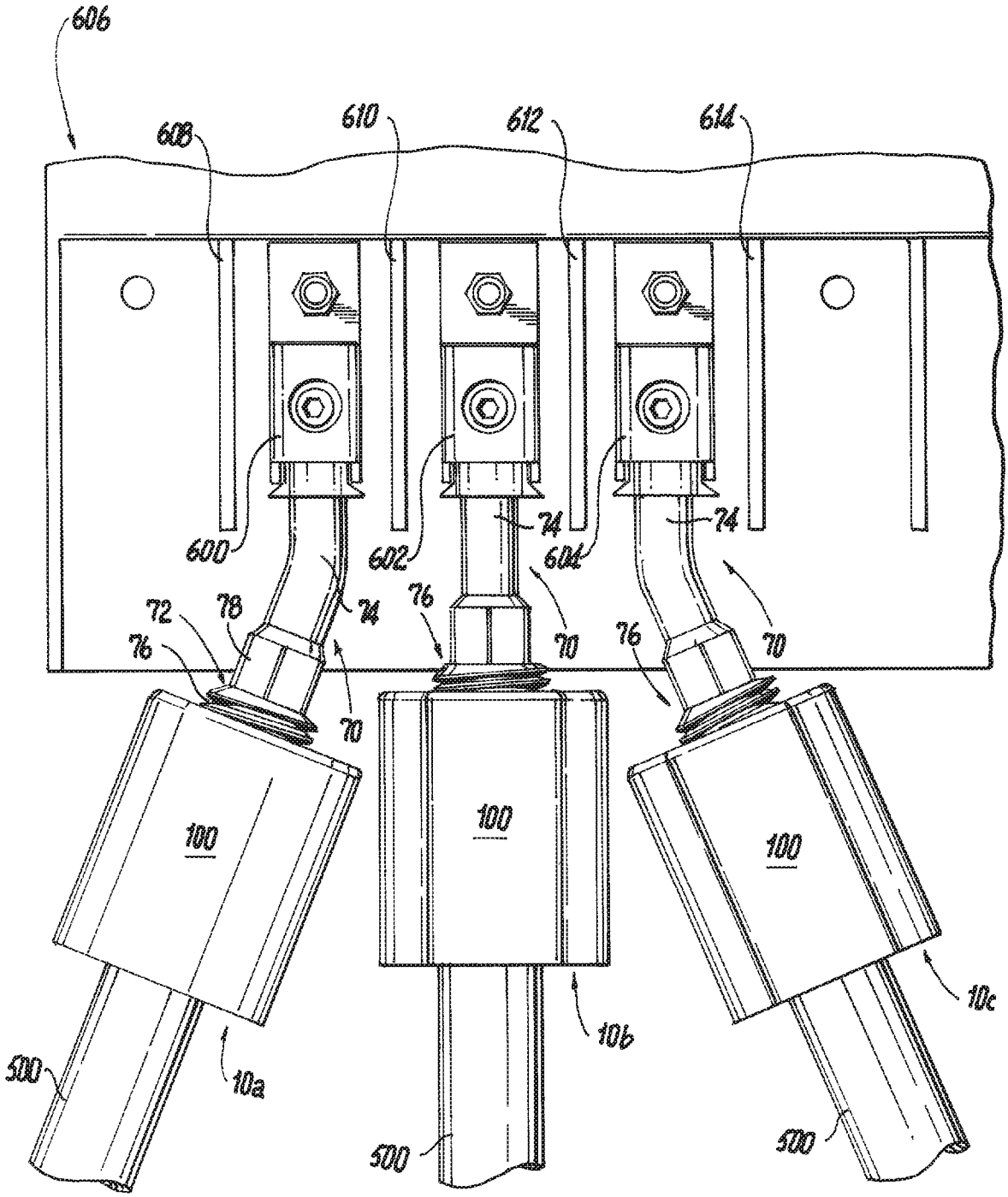
FIG. 19 is a top plan view of a portion of an electrical panel and multiple conductors secured to mechanical connectors in the electrical panel using embodiments of the connectors of the present disclosure, illustrating two mechanical type connectors with pin adapters having pins with 22 degree bends secured to the outer mechanical connectors of the electrical panel and a mechanical type connector with a pin adapter having a straight pin secured to the center mechanical connector of the electrical panel.

Referring now to FIGS. 3, 5-7 and 19, the pin 74 is preferably a cylindrical structure or has a circular cross-section that can be received within mechanical connectors or terminations of electrical equipment. However, it would be readily appreciated that the pin may have any suitable shape sufficient to be received within mechanical connectors or terminations of electrical equipment, such as a square shape or a rectangular shape. The pin 74 is made of an electrically conductive material, such as aluminum, copper or brass. In some exemplary embodiments, the pin 74 may be integrally or monolithically formed into the adapter body 72 or secured to the adapter body with, for example, welds. In other exemplary embodiments, the pin 74 may be removably attached to the adapter body 72 with, for example, set screws. In the embodiment of FIG. 3, the pin 74 is a straight pin having a longitudinal axis that is aligned with the longitudinal axis of the adapter body 72. In the embodiments of FIGS. 5-7, the pin 74 includes different bends. For example, in FIG. 5 the pin 74 has a 45 degree bend relative to the longitudinal axis of the adapter body 72. In FIG. 6, the pin 74 has a 90 degree bend relative to the longitudinal axis of the adapter body 72. In FIG. 7, the pin 74 has an S-shaped bend relative to the longitudinal axis of the adapter body 72. In FIG. 19, the pin 74 has a 22 degree bend relative to the longitudinal axis of the adapter body 72. The pin may also include other bend types and shapes.

Figure 8:
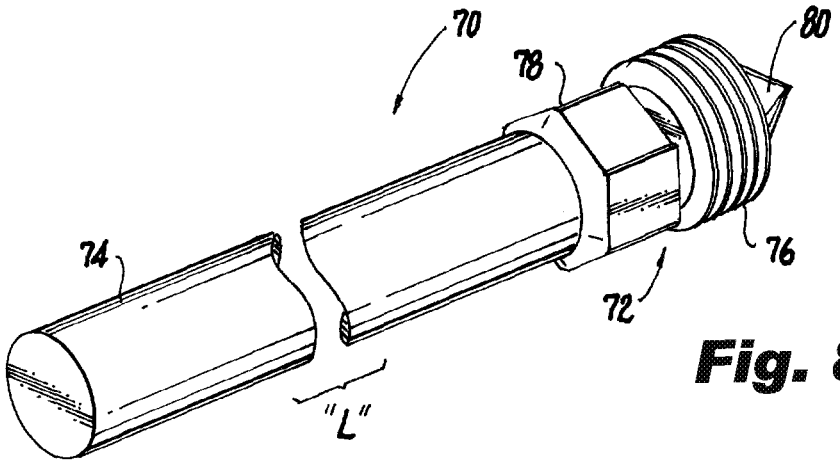
FIG. 8 is a perspective view of another exemplary embodiment of a pin adapter according to the present disclosure, illustrating an adapter body extending from the adapter body having a pointed tip and a straight pin with a break in the pin reflecting an indefinite length.
Figure 9:
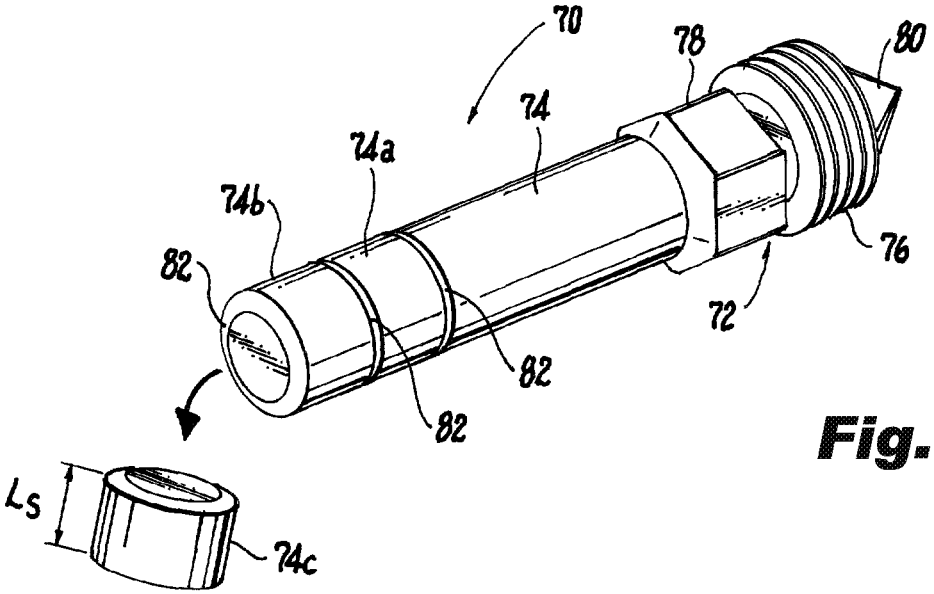
FIG. 9 is a perspective view of another exemplary embodiment of a pin adapter according to the present disclosure, illustrating an adapter body with a pointed tip and a straight pin extending from the adapter body having breakaway segments that can be removed from the pin to change the length of the pin.

Referring to FIG. 8, the length "L" of the pin 74 of the pin adapter 70 may be a fixed length suitable for a particular use of the connector 10. For example, the fixed length "L" of the pin 74 may be in the range of about 1 inch to about 5 inches. In an alternative embodiment, the length "L" of the pin 74 of the pin adapter 70 may be segmented into for example ½-inch segments, such that the length "L" of the pin 74 may be reduced in the field, as seen in FIG. 9. More specifically, the pin 74 may include one or more breakaway notches 82, e.g., V-shaped notches, that define the pin segments, e.g., pin segments 74*a*, 74*b* and 74*c*, that can be cut off or broken off the pin 74 to change the length "L" of the pin. The pin segments, e.g., pin segments 74*a*, 74*b* and 74*c*, may have the same length "Ls" or the pin segments may have different lengths "Ls" or the pin segments may have a combination of same length pin segments combined with different length pin segments.

Figure 10:
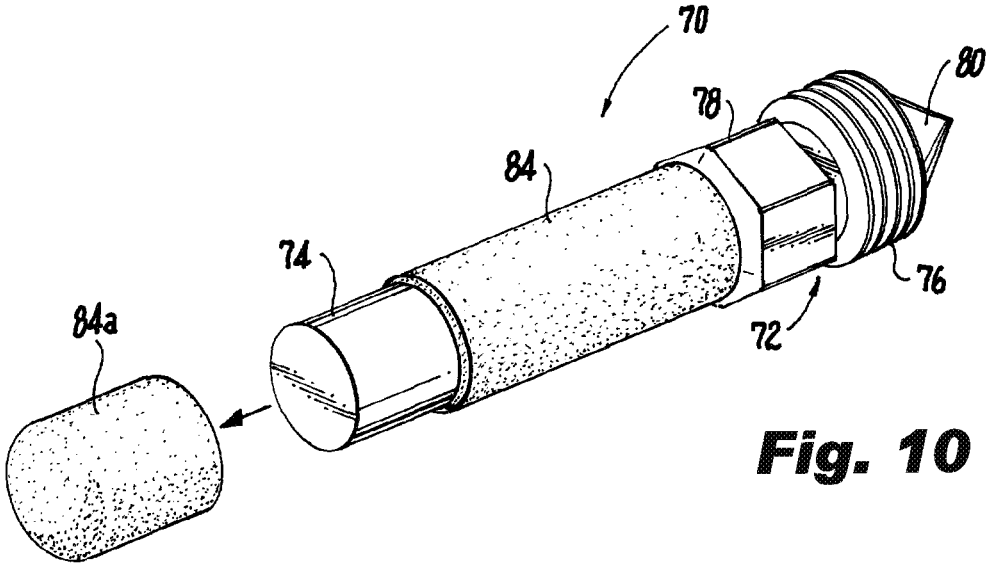
FIG. 10 is a perspective view of another exemplary embodiment of a pin adapter according to the present disclosure, illustrating an adapter body with a pointed tip, a straight pin extending from the adapter body, and an insulating jacket covering the pin where a portion of the insulating jacket is removed for making an electrical connection.

Referring to FIG. 10, the pin 74 may include an insulating jacket 84 that surrounds all or a portion of the pin 74 to insulate all or a portion of the pin 74. The insulating jacket 84 may be a sleeve that is inserted over the pin 74, or the pin 74 may be dipped into a vat of liquid insulating material and then the insulating material is allowed to cool and harden to form the insulation jacket 84. The insulating jacket 84 may also be applied to the pin 74 using an injection moulding process as is known. The insulating jacket 84 may be made of a flexible, heat and moisture resistant electrical insulating material. Non-limiting examples of materials that can be used to form the insulating jacket 84 include, THHN and THWN conductor insulators, thermoplastic materials, nylon, polyvinyl chloride (PVC), ethylene propylene diene monomer (EPDM) rubber, Santoprene and Plastisol. In the exemplary embodiment of FIG. 10, the entire pin 74 includes the insulating jacket 84 and a portion 84*a* of the insulating jacket 84 is removed from a distal end of the pin 74 to expose a portion of the pin for connection to mechanical connectors or terminations of electrical equipment that the connector 10.

Figure 11:
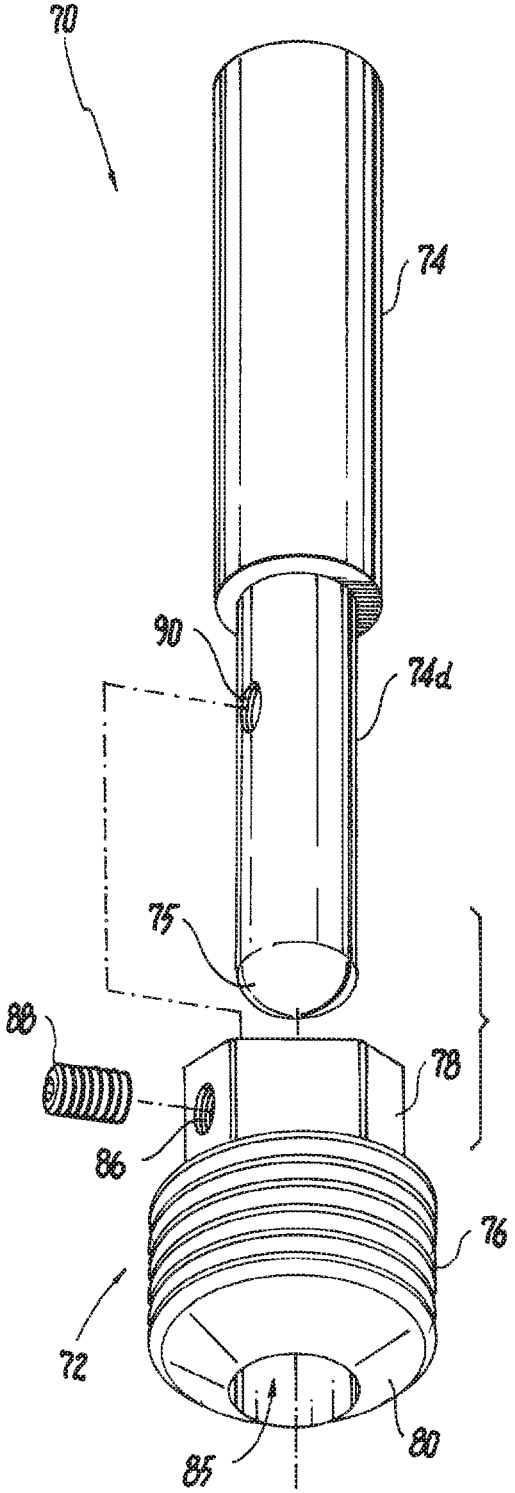
FIG. 11 is an exploded perspective view of another exemplary embodiment of a pin adapter according to the present disclosure, illustrating an adapter body having a tapered tip with a center bore and a pin with blunt tip that can be removable attached to the adapter body.
Figure 12:
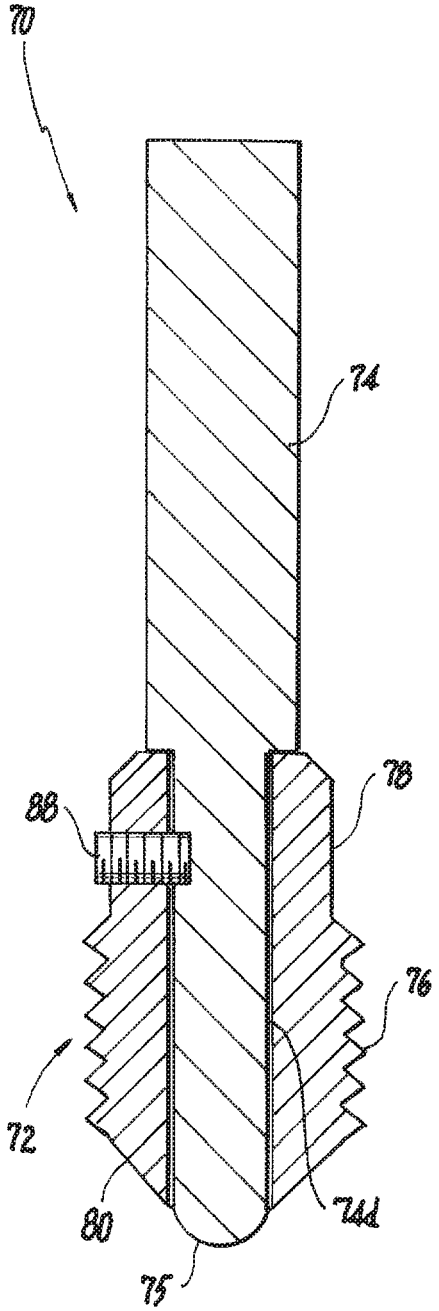
FIG. 12 is a cross-sectional view of the assembled pin adapter of FIG. 11, illustrating the removable pin attached to the adapter body using a fastener.
Figure 13:
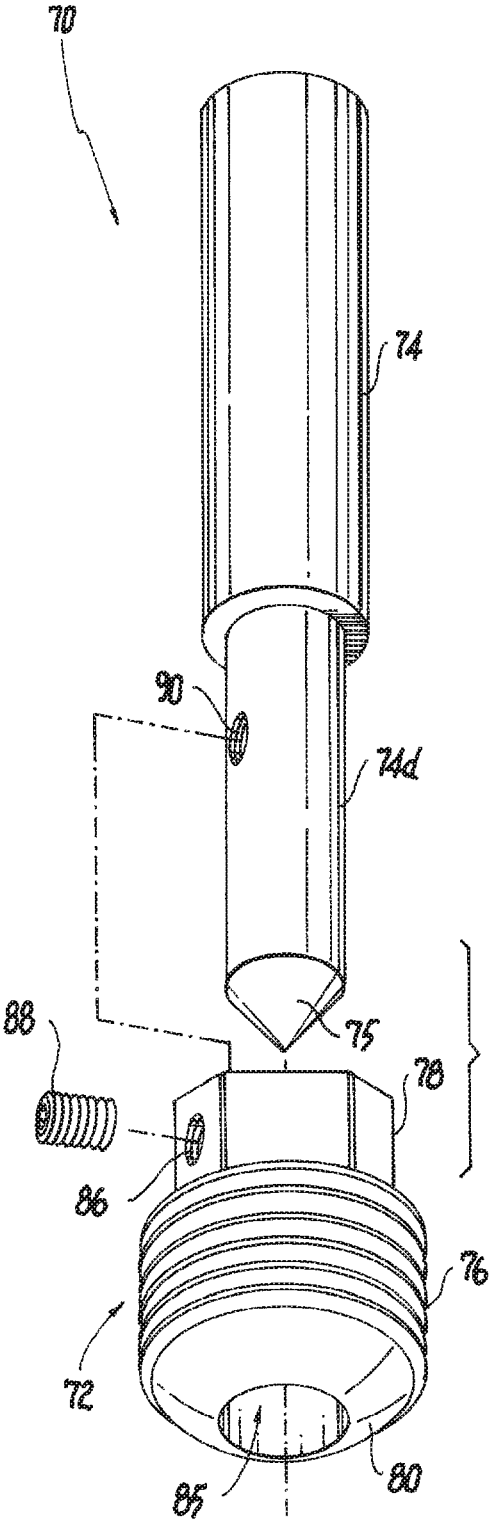
FIG. 13 is an exploded perspective view of another exemplary embodiment of a pin adapter according to the present disclosure, illustrating an adapter body having a tapered tip with a center bore and a pin with pointed tip that can be removable attached to the adapter body.
Figure 14:
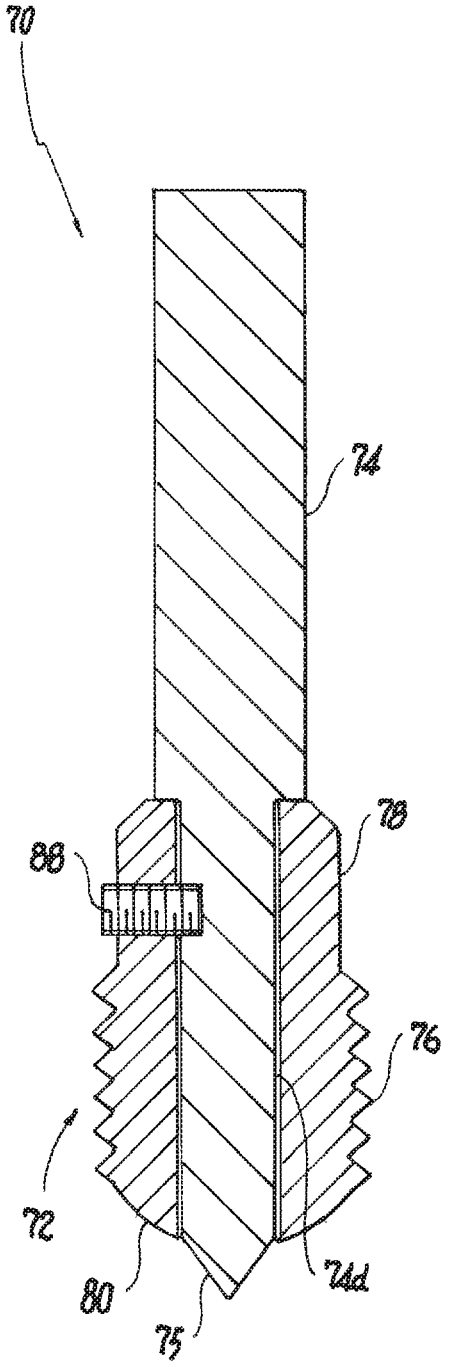
FIG. 14 is a cross-sectional view of the assembled pin adapter of FIG. 13, illustrating the removable pin attached to the adapter body using a fastener.

Turning to FIGS. 11-14, additional exemplary embodiments of the pin adapter 70 according to the present disclosure are shown, where the pin 74 is removably attached to the adapter body 72. In these embodiments, the adapter body 72 includes a mounting portion 76, a tightening portion 78 and a tip portion 80 as described above, and the pin 74 includes a proximal end portion 74*d* that ends at a tip 75. In the embodiment of FIGS. 11 and 12 the tip 75 is a blunt tip, and in the embodiment of FIGS. 13 and 14 the tip 75 is a pointed tip. The proximal end portion 74*d* of the pin 74 may include a threaded bore 90 that can be used when releasably securing the pin to the adapter body 72. The threaded bore 90 may be positioned along the proximal end portion 74*d* at a point where the tip 75 extends beyond the tip portion 80 of the adapter body 72, as seen in FIGS. 12 and 14. However, it is readily appreciated that the threaded bore 90 may be positioned along the proximal end portion 74*d* at a point where the tip 75 does not extend beyond the tip portion 80 of the adapter body 72. In this exemplary embodiment, the adapter body 72 includes a longitudinal bore 85 that is configured to receive the proximal end portion 74*d* of the pin 74, as shown in FIGS. 12 and 14. To secure the pin 74 to the adapter body 72, the tightening portion 78 of the adapter body 70 has a threaded bore 86 configured to receive a fastener 88, which in this exemplary embodiment is a set screw. When the proximal end portion 74*d* of the pin 74 is inserted into the longitudinal bore 85 of the adapter body 72 so that the threaded bore 90 is aligned with the threaded bore 86, the fastener 88 can be tightened to enter the threaded bore 90 thereby releasably securing the pin 74 to the adapter body 72.

Referring again to FIG. 3, the connector 10 according to the present disclosure may also include an insulating cover 100. The insulating cover 100 is shaped to fit over and around the connector body 20, as shown. The insulating cover 100 includes a cover body 102 with an open end 104, a closed end 105 and a cavity between the open end and the closed end. The closed end 105 includes a cover bore 106 through which the portion of the pin adapter 70 extending from the connector body 20 can pass when the insulating cover 100 is installed on the connector body 20. The cover body 102 may include a keyway 108 that extends longitudinally along an exterior of the cover body 102. The keyway 108 is in communication with the cavity in the cover body 102 and is configured to receive at least a portion of the fastener 30 in the event the fastener 30 extends above the exterior wall of the connector body 20. The insulating cover 100 may be made of a flexible, heat and moisture resistant electrically insulating material. Non-limiting examples of materials that can be used to form the insulating cover 100 include, THEN and THWN conductor insulators, thermoplastic materials, nylon, polyvinyl chloride (PVC), ethylene propylene diene monomer (EPDM) rubber, Santoprene and Plastisol.

Figure 15:
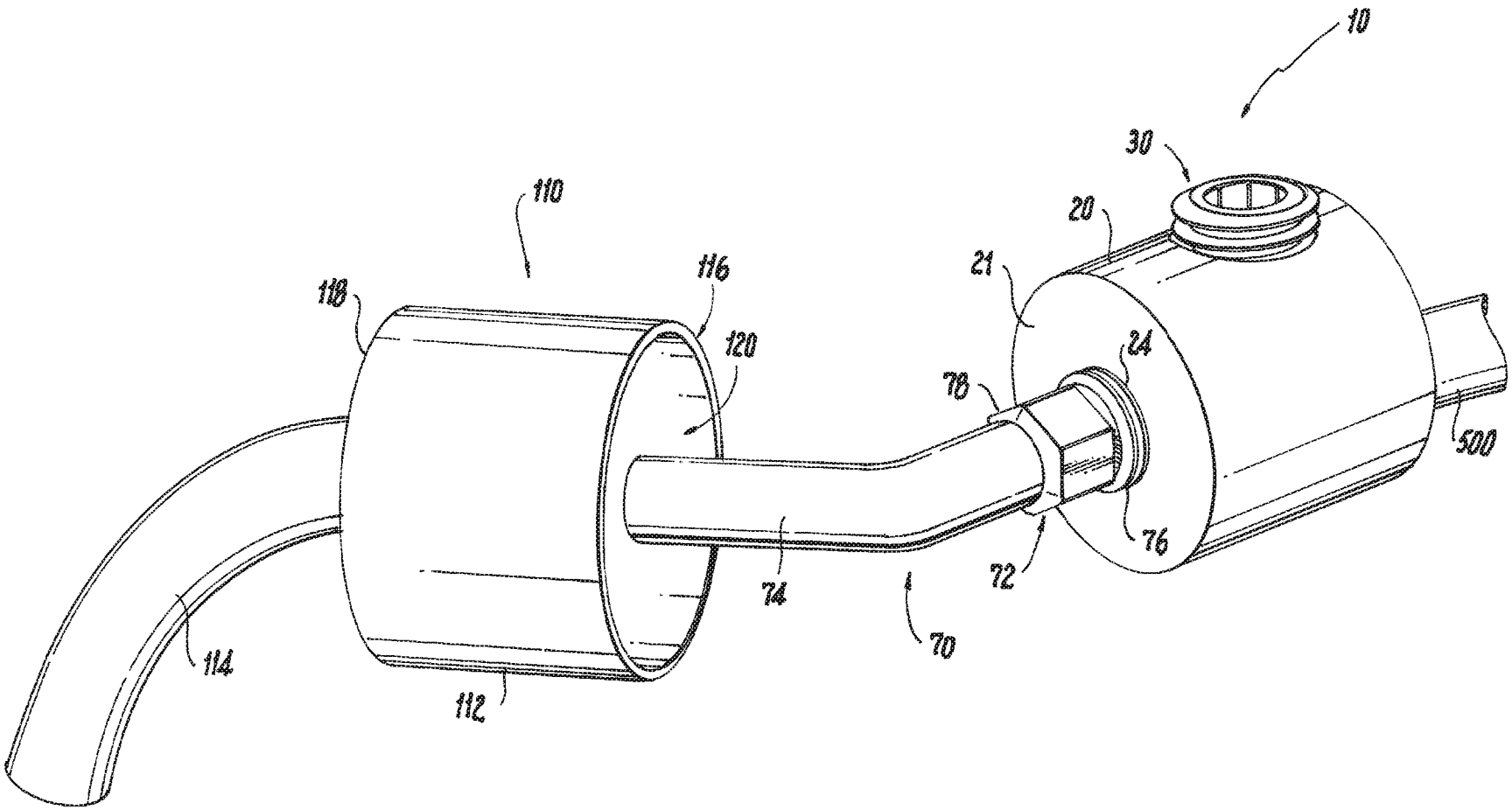
FIG. 15 is a perspective view of another exemplary embodiment of a mechanical type connector according to the present disclosure, illustrating a connector body having a pin adapter extending from an adapter body bore in the connector body and an insulating cover having a cover body and a pin sleeve extending from the cover body.
Figure 15A:
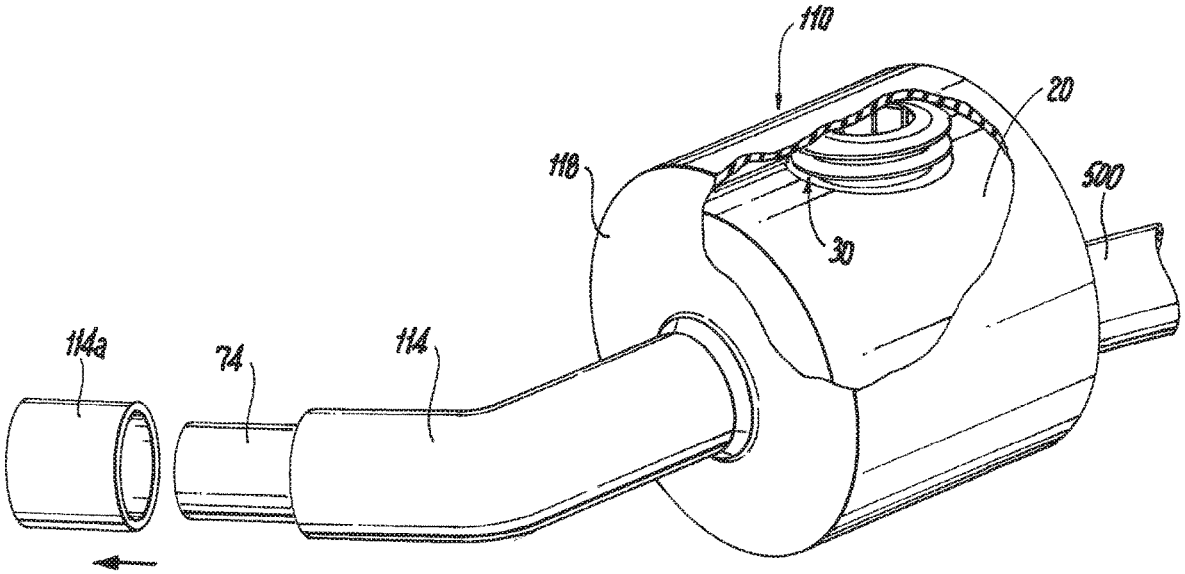
FIG. 15A is a perspective view of the mechanical type connector of FIG. 15, illustrating the cover body of the insulating cover covering the connector body and the pin sleeve covering the pin of the pin adapter with a portion of the pin sleeve cut away to permit an electrical connection with the pin.

Referring to FIGS. 15 and 15A, another exemplary embodiment of the insulating cover is shown. In this exemplary embodiment, the insulating cover 110 includes a cover body 112 and a pin sleeve 114 extending from the cover body 112. The cover body 112 has an open end 116, a closed end 118 and a cavity 120 between the open end and the closed end. The pin sleeve 114 is positioned on the cover body 112 so that it aligns with the pin 74 of the pin adapter 70. Thus, if the pin adapter 70 is centered on the connector body 20, the pin sleeve 114 would be centered on the cover body 112 so that the pin 74 is aligned with the pin sleeve 114. If 74 the pin adapter 70 is offset from the center of the connector body 20, the pin sleeve 114 would be offset from the center of the cover body 112 so that the pin 74 is aligned with the pin sleeve 114. When mounting the insulating cover 110 to the connector 10, the pin 74 of the pin adapter 70 is inserted into the body cover body 112 and into the pin sleeve 114 until the cover body 112 is positioned over the connector body 20 and the pin sleeve covers the pin 74, as shown in FIG. 15A. In the exemplary embodiment of FIGS. 15 and 15A, the entire pin 74 is covered by the pin sleeve 114. However, the pin sleeve 114 may be configured not to cover the entire pin 74 such that a portion of the pin is exposed. When connecting the connector 10 to mechanical connectors or terminations of electrical equipment, a portion 114*a* of the pin sleeve 114 is removed from a distal end of the pin 74 to expose a portion of the pin for connection to the mechanical connectors or terminations of the electrical equipment to which the connector 10. The cover body 112 and the pin sleeve 114 are preferably made of a flexible, heat and moisture resistant electrically insulating material. Non-limiting examples of materials that can be used to form the insulating cover 110 include, THEN and THWN conductor insulators, thermoplastic materials, nylon, polyvinyl chloride (PVC), ethylene propylene diene monomer (EPDM) rubber, Santoprene and Plastisol.

Referring to FIGS. 16 and 17, another exemplary embodiment of a mechanical type connector according to the present disclosure is shown. In this exemplary embodiment, the connector 150 is similar to the connector 10 described above such that like elements are assigned the same numerals. A different between the connector 10 and the connector 150 is that the connector body 20 is elongated so that the connector body can include two fastener bores 26 and two fasteners 30 to releasably secure the bare portion 502 of the conductor 500 to the connector body 20. In addition, the adapter bore 24 does not extend through the wall 21 in the connector body 20 and the tip portion 80 of the adapter body 72 is a blunt tip. Further, the cover body 102 of the insulating cover 100 is also elongated so that the elongated connector body 20 fits within the cover body 102 when the insulating cover 100 is installed on the connector body 20.

Figure 18:
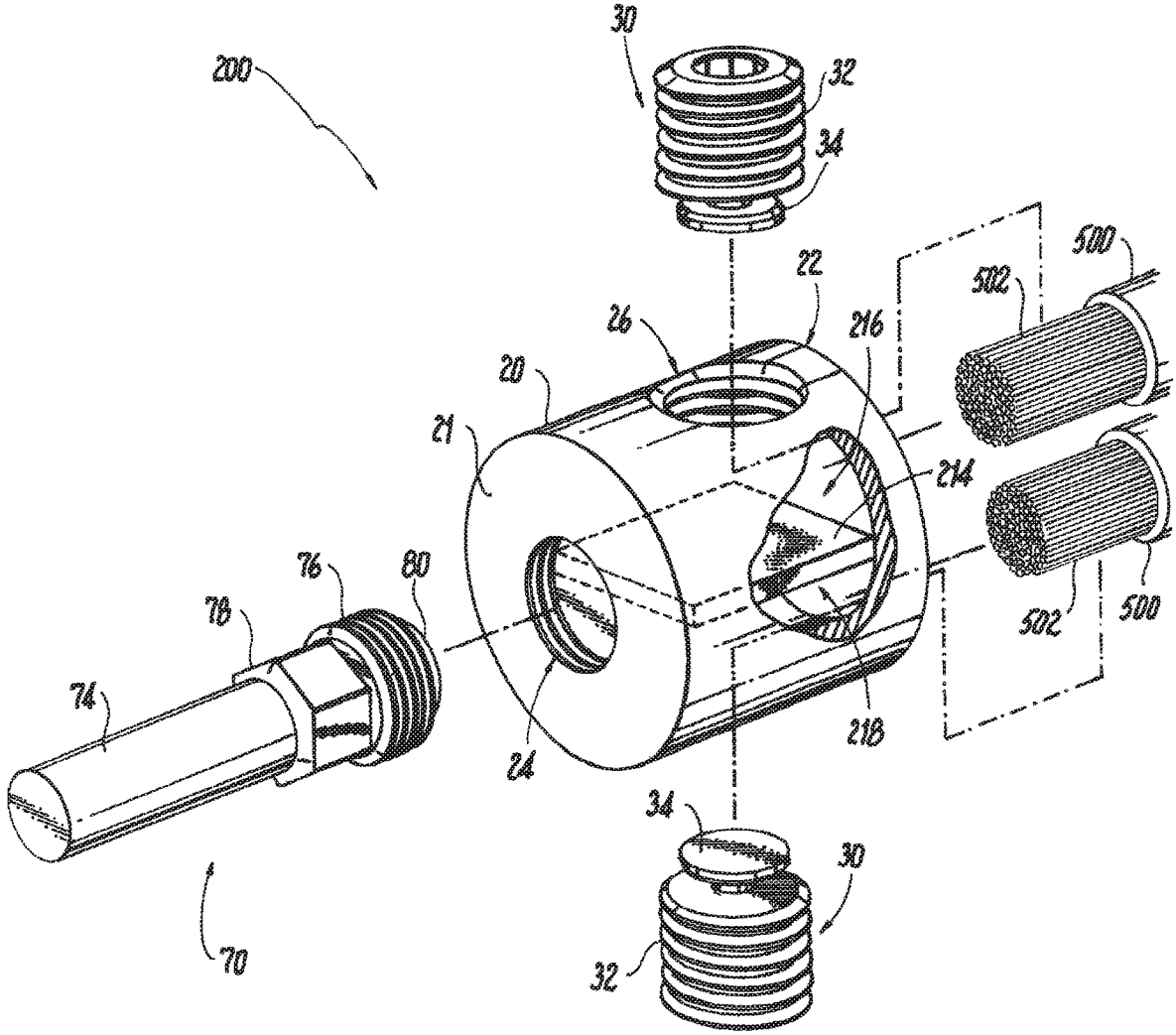
FIG. 18 is an exploded perspective view of another exemplary embodiment of a mechanical type cable connector according to the present disclosure, illustrating a connector body segmented to receive multiple conductors, multiple fasteners used to secure the multiple conductors to the connector body and a pin adapter extending from an adapter body bore in the connector body.

Turning to FIG. 18, another exemplary embodiment of a mechanical type connector according to the present disclosure is shown. In this exemplary embodiment, similar elements to those described above are assigned the same numerals and a detailed description of such elements are not repeated for this embodiment. The connector 200 includes a connector body 20 and a pin adapter 70. The connector body 20 is preferably a circular body that is made of an electrically conductive material, such as aluminum, copper or brass. The conductor body 20 includes a conductor bore 22, a pin adapter bore 24 in a closed wall 21 of the conductor body, and multiple fastener bores 26. Preferably, the wall of the conductor bore 22 is a smooth wall. The conductor body 20 includes a divider plate 214 within the conductor bore 22. The divider plate 214 divides the conductor bore into two compartments 216 and 218. Each compartment 216 and 218 is configured to receive a bare portion 502 of an electrical conductor 500, as shown. The pin adapter bore 24 is configured to receive an adapter body 72 of the pin adapter 70, as described above. The fastener bores 26 are preferably threaded bores that receives a threaded fastener 30. In this embodiment, at least one fastener bore 26 is aligned with the compartment 216, and at least one fastener bore 26 is aligned with the compartment 218. The fasteners 30 are used to secure the bare portions 502 of the conductors 500 within the respective compartment 216 and 218, as described above.

FIG. 19 illustrates three connectors 10*a*, 10*b* and 10*c* connected to mechanical connectors 600, 602 and 604 of an electrical panel 606. The mechanical connectors 600, 602 and 604 are separated by dividers 608, 610, 612 and 614. Each connector 10*a*, 10*b* and 10*c* has an insulating cover 100, similar to the insulating cover shown in FIG. 3 but without the keyway 108. As shown, the center connector 10*b* includes a pin adapter 70 with a straight pin 74 having a length "L" that permits the connector body 20 of the connector 10 to be in close proximity to the mechanical connector 602. The left connector 10*a* includes a pin adapter 70 with a pin 74 having a 22-degree bend and a length "L" sufficient to allow the connector body 20 of the connector 10*a* to avoid contacting the connector body 20 of the center connector 10*b*. Similarly, the right connector 10*c* includes a pin adapter 70 with a pin 74 having a 22-degree bend and a length "L" sufficient to allow the connector body 20 of the connector 10*c* to avoid contacting the connector body 20 of the center connector 10*b*. As shown, the pin 74 of the pin adapters 70 permit the connectors 10*a*, 10*b* and 10*c* to avoid interference from the dividers 608, 610, 612 and 614, and to avoid contacting each other.

Figure 20:
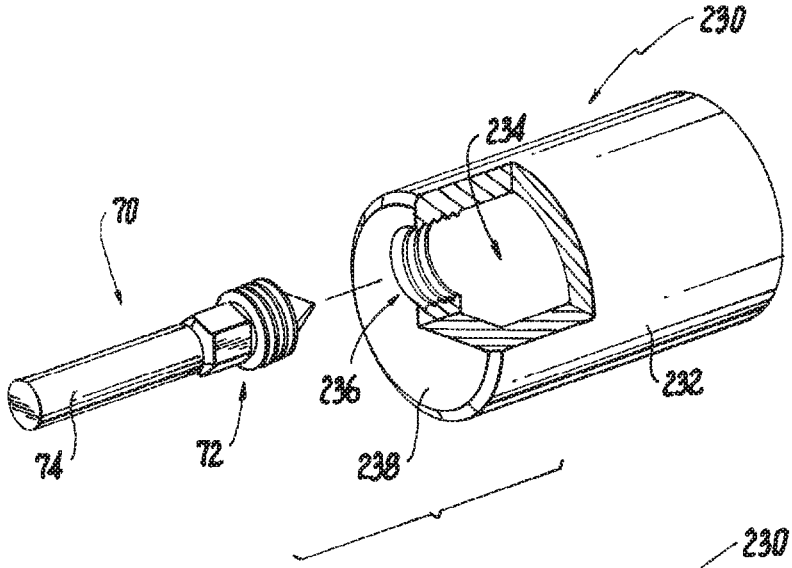
FIG. 20 is an exploded perspective view of an exemplary embodiment of a compression type connector according to the present disclosure, illustrating a connector body having an adapter body bore that is offset from a center of the connector body and a pin adapter having an adapter body with a pointed tip aligned with the adapter body bore and a straight pin extending from the adapter body.
Figure 21:
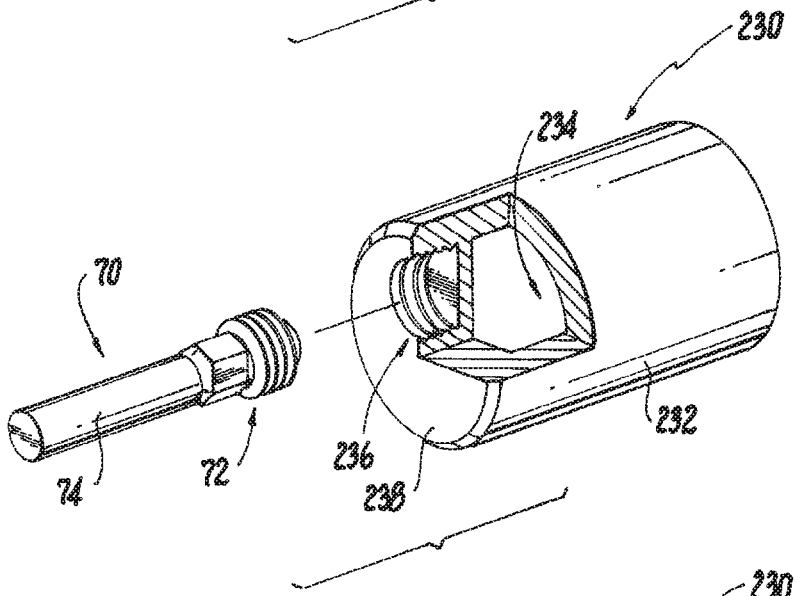
FIG. 21 is an exploded perspective view of another exemplary embodiment of a compression type connector according to the present disclosure, illustrating a connector body having an adapter body bore that is offset from a center of the connector body, and a pin adapter having an adapter body with a blunt tip aligned with the adapter body bore and a straight pin extending from the adapter body.
Figure 22:
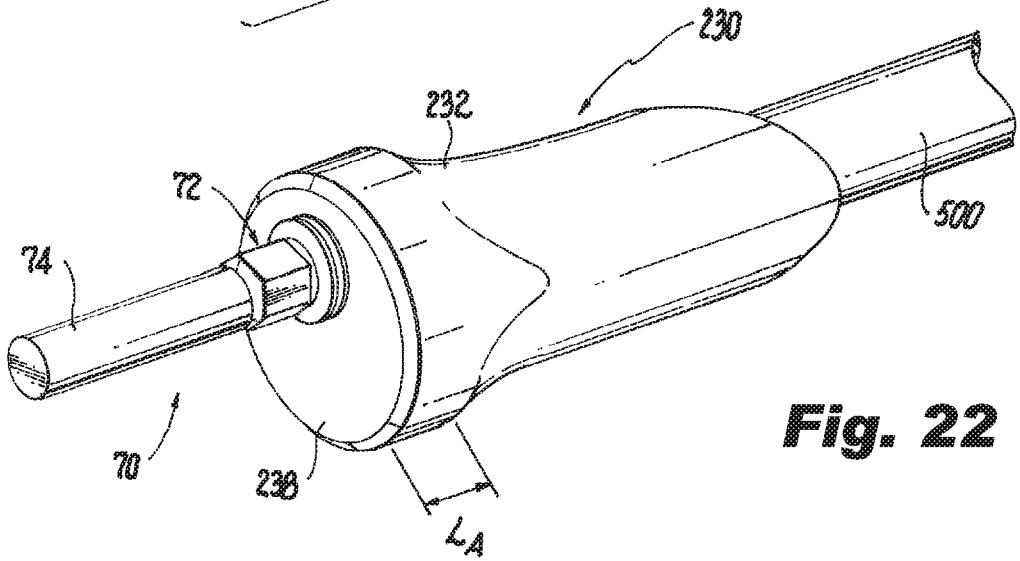
FIG. 22 is a perspective view of the compression type connector of FIG. 20 or FIG. 21, illustrating the connector body crimped to secure a bare portion of a conductor to the connector body.

Turning now to FIGS. 20-22, exemplary embodiments of compression type connectors according to the present disclosure are shown. In these exemplary embodiments, similar elements to those described above are assigned the same numerals and a detailed description of such elements are not repeated for this embodiment. The connector 230 includes a connector body 232 and a pin adapter 70. The connector body 232 is preferably a circular body that is made of an electrically conductive material, such as aluminum, copper or brass. The conductor body 232 includes a conductor bore 234 and a pin adapter bore 236 in a closed wall 238 of the conductor body. Preferably, the interior wall of the conductor bore 234 is a smooth wall. As described above, the pin adapter bore 236 may be centered in the closed wall 238 or may be offset from the center of the closed wall 238 as shown. In this exemplary embodiment, after a bare portion of a conductor 500 is inserted into the conductor bore 234 of the conductor body 232, the conductor body is compressed using, for example a hydraulic power tool, to permanently secure the bare portion of the conductor 500 to the connector body 232, as shown in FIG. 22. It is noted that the insulating covers described above may be used to cover the connector body 232 and/or the pin adapter 70.

Figure 23:
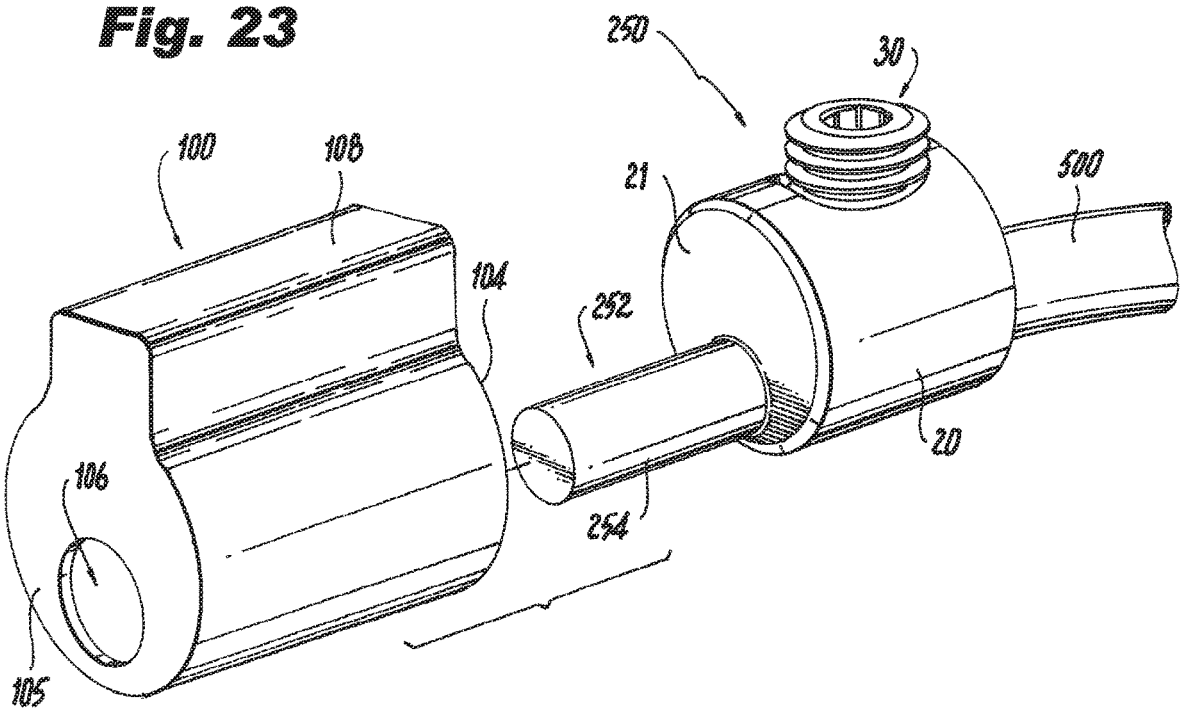
FIG. 23 is a perspective view of another exemplary embodiment of a mechanical type cable connector according to the present disclosure, illustrating a connector body having a fixed pin extending from the connector body, and illustrating an insulating cover that fits over the connector body.
Figure 24:
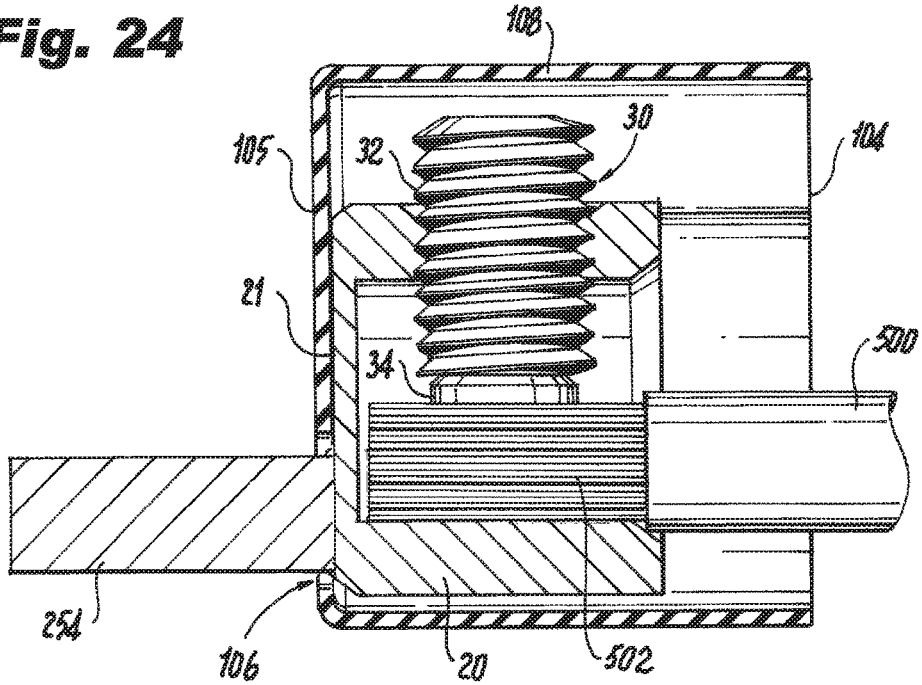
FIG. 24 is a cross-sectional view of the mechanical cable connector of FIG. 23, illustrating a bare portion of a conductor secured to the connector body with a fastener.

Referring now to FIGS. 23 and 24, another exemplary embodiment of a mechanical type connector according to the present disclosure is shown. In this exemplary embodiment, the connector 250 is similar to the connector 10 described above so that elements similar to those described above utilize the same numerals and a detailed description of such elements are not repeated for this embodiment. In this exemplary embodiment, the pin adapter 252 differs from pin adapter 70 in that the pin 254 is integrally or monolithically formed into the conductor body 20 or permanently secured to the conductor body 20 by, for example, welds. The connector 250 according to the present disclosure may also include an insulating cover described above.

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

What is claimed is:

1. A cable connector comprising:

a connector body having a conductor bore, a pin adapter bore, and at least one fastener bore in communication with the conductor bore;

at least one fastener movably received within the at least one fastener bore such that the at least one fastener can enter the conductor bore; and a pin adapter removably secured within the pin adapter bore, the pin adapter including an adapter body adapted to be received within the pin adapter bore and a pin having a bend and extending from the adapter body.

2. The cable connector according to claim 1, further comprising an insulating cover that fits at least around the connector body.

3. The cable connector according to claim 2, wherein the insulating cover fits around the connector body and at least a portion of the pin adapter.

4. The cable connector according to claim 1, wherein the at least one fastener comprises a fastener body and a fastener plate operatively coupled to the fastener body such that the fastener plate is independently movable relative to the fastener body.

5. The cable connector according to claim 1, wherein the adapter body comprises a mounting portion, a tightening portion extending from a first end of the mounting portion and a tip portion extending from a second end of the mounting portion.

6. The cable connector according to claim 5, wherein the mounting portion comprises threading that is received in the pin adapter bore.

7. The cable connector according to claim 5, wherein the tip portion comprises a pointed tip or a blunt tip.

8. The cable connector according to claim 1, wherein the bend in the pin is one of a 22 degree bend, a 45 degree bend, a 90 degree bend and an S-shaped bend.

9. The cable connector according to claim 1, wherein at least a portion of the pin has an insulating jacket.

10. The cable connector according to claim 1, wherein the pin is releasably secured to the adapter body.

11. The cable connector according to claim 1, wherein the pin includes at least one breakaway notch.

12. A cable connector comprising:

a connector body having a conductor bore and at least one fastener bore in communication with the conductor bore;

at least one fastener movably received within the at least one fastener bore such that the at least one fastener can enter the conductor bore; and a pin having one end permanently secured to the connector body and a free end, the pin having a bend.

13. The cable connector according to claim 12, further comprising an insulating cover that fits at least around the connector body.

14. The cable connector according to claim 13, wherein the insulating cover fits around the connector body and at least a portion of the pin.

15. The cable connector according to claim 12, wherein the fastener comprises a fastener body and a fastener plate operatively coupled to the fastener body such that the fastener plate is independently movable relative to the fastener body.

16. The cable connector according to claim 12, wherein the bend is one of a 22 degree bend, a 45 degree bend, a 90 degree bend and an S-shaped bend.

17. A cable connector comprising:

a connector body having a conductor bore, a pin adapter bore, and at least one fastener bore in communication with the conductor bore;

at least one fastener movably received within the at least one fastener bore such that the at least one fastener can enter the conductor bore;

a pin adapter removably secured within the pin adapter bore, the pin adapter including an adapter body adapted to be received within the pin adapter bore and a pin having a bend and extending from the adapter body; and an insulating cover that fits at least around the connector body.

18. The cable connector according to claim 17, wherein the insulating cover fits around the connector body and at least a portion of the pin adapter.

19. The cable connector according to claim 17, wherein the at least one fastener comprises a fastener body and a fastener plate operatively coupled to the fastener body such that the fastener plate is independently movable relative to the fastener body.

20. The cable connector according to claim 17, wherein the bend in the pin is one of a 22 degree bend, a 45 degree bend, a 90 degree bend and an S-shaped bend.

21. The cable connector according to claim 17, wherein at least a portion of the pin has an insulating jacket.

22. The cable connector according to claim 17, wherein the pin is releasably secured to the adapter body.

23. The cable connector according to claim 17, wherein the pin includes at least one breakaway notch.

* * * * *